US005362178A

United States Patent [19]

Schantz

[11] Patent Number: 5,362,178

[45] Date of Patent: Nov. 8, 1994

[54] APPARATUS FOR SPREADING SEALANT

[76] Inventor: John S. Schantz, 10775 Pocahontas Rd., Marine, Ill. 62061

[21] Appl. No.: 54,394

[22] Filed: Apr. 28, 1993

[51] Int. Cl.[5] ..... E01C 19/12

[52] U.S. Cl. ..... 404/101; 404/110; 404/111; 222/167

[58] Field of Search ..... 404/101, 110, 111, 113, 404/83; 239/164, 176, 142, 455, 451, 379, 562

[56] References Cited

U.S. PATENT DOCUMENTS

| | | | |
|---|---|---|---|
| 2,953,977 | 9/1960 | Warren | 404/110 |
| 3,230,845 | 1/1966 | Mauldin | 404/110 |
| 3,703,856 | 11/1972 | Wikel et al. | 404/111 |
| 3,901,411 | 8/1975 | Bauman | 222/167 |
| 3,989,403 | 11/1976 | Verive | 404/111 |
| 4,477,203 | 10/1984 | Laditka | 404/111 |

*Primary Examiner*—Ramon S. Britts
*Assistant Examiner*—Pamela Anne O'Connor
*Attorney, Agent, or Firm*—Robbins & Robbins

[57] ABSTRACT

An apparatus for spreading a liquid over a surface, such as sealant over a pavement, is provided. The apparatus is mounted on a trailer and is comprised of a storage bin for containing the liquid to be spread, a drainage trough, and spreading brushes. Liquid is mixed in the storage bin and then transferred to the drainage trough where it is then dispersed onto the surface for spreading as the apparatus is towed along. The width of the path of dispersed liquid laid down by the drainage trough can be adjusted if necessary for sidewalks or other narrower surfaces. The brushes spread the liquid evenly over the surface. The drainage trough and brushes are hingedly connected to the storage bin and are pivotable between positions of operation and transport.

17 Claims, 9 Drawing Sheets

FIG. 10
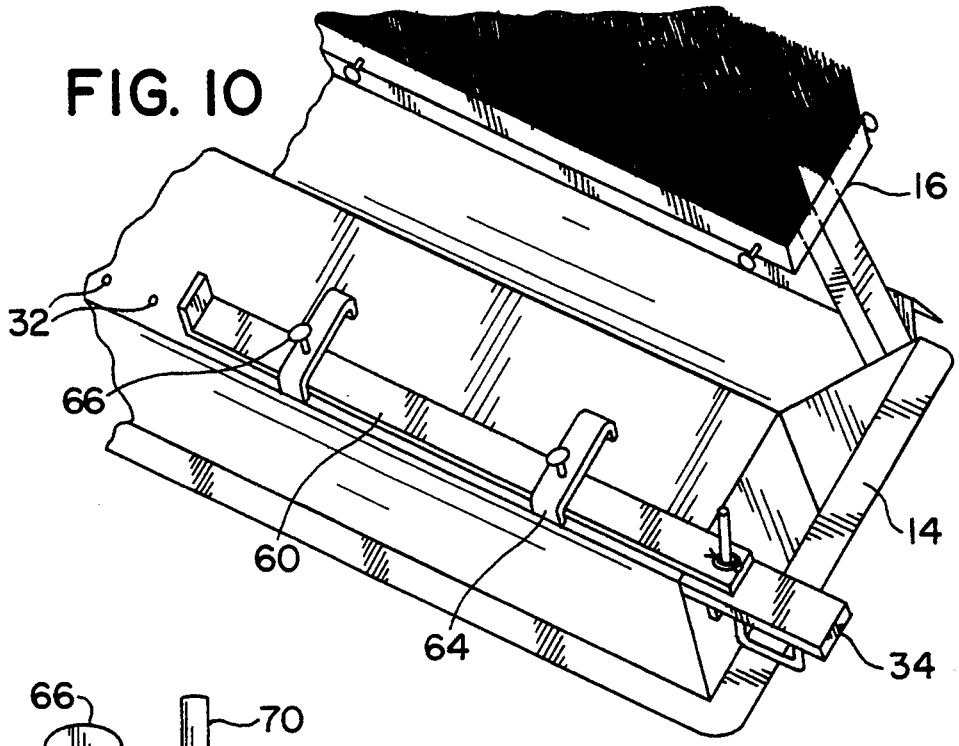
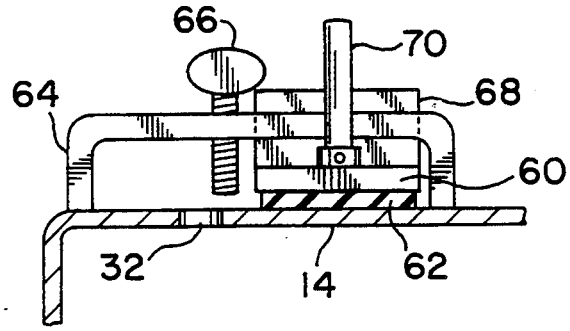
FIG. 11
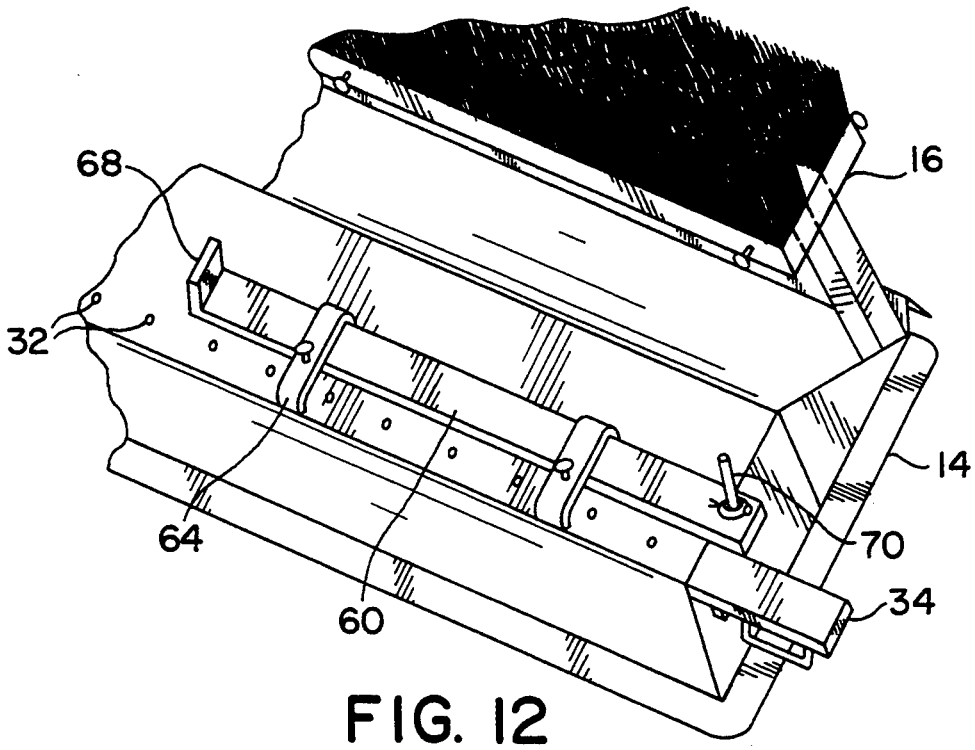
FIG. 12

APPARATUS FOR SPREADING SEALANT

BACKGROUND OF THE INVENTION

This invention relates to equipment used for spreading sealant on paved surfaces and the like.

Asphalt, concrete and other paved surfaces are subject to cracking, weathering and other deteriorating conditions over time. They must be maintained periodically to preserve their condition and appearance. Various liquid sealants are available for application to these surfaces to repair and fill cracks, and provide preserving agents to help retard the weathering process.

Paved driveways and parking lots are found at many homes and small businesses. It has long been a problem, however, for the homeowner or small business owner to maintain the condition of the paved surface. A person can hire someone else to apply the sealant, using various types of machinery or a crew of laborers, at great expense, or can apply the sealant himself. It is a tedious job to apply sealant liquid, and can get overwhelming if the surface covers a substantial area. Sealant spreading equipment is the most efficient means of application yet can be quite expensive. Using a mop and bucket is extremely laborious.

There exists a need for equipment which is simple in construction and modest in cost, yet can efficiently apply sealant over any size area. It would be desirable if such equipment was capable of being towed behind a vehicle for use, as well as for transportation between job sites. Equipment satisfying these needs would be useful to the pavement owner, and also to entrepreneurs who might wish to get into the sealant spreading business.

SUMMARY OF THE INVENTION

By means of the instant invention there is provided an apparatus for spreading a liquid over a surface. The apparatus is comprised of a storage bin for containing and mixing the liquid, a drainage trough for dispersing the liquid onto the surface and a spreading attachment for distributing the liquid over the surface. The apparatus is adapted to be mounted on a trailer dolly for mobility. This enables the apparatus to be towed along the surface over which liquid is to be spread, and also to be transported between job sites.

Sealant is contained and mixed in the storage bin using a hand cranked agitator, then transferred to the drainage trough through spigots. The rate of flow of sealant dispersed on to the surface to be treated can be controlled by adjusting the size of the holes at the bottom of the drainage trough. The width of the path of dispersed liquid laid down by the drainage trough can be adjusted if necessary for sidewalks or other narrower surfaces. The spreading attachment receives brushes which follow behind and spread the deposited sealant as the apparatus is towed along. The drainage trough and spreading attachment are hingedly connected to the storage bin, and can be retracted from an operable position to a stowed position for transport.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

FIG. 10 is a perspective view of the bottom of the drainage trough showing the dispersion width regulator bar covering the outer drainage holes of the trough.

FIG. 11 is a perspective view of the bottom of the drainage trough showing the dispersion width regulator bar displaced from the drainage holes of the trough.

FIG. 12 is a view in side elevation of the bottom end of the inverted drainage trough.

DESCRIPTION OF THE INVENTION

Figure 1:
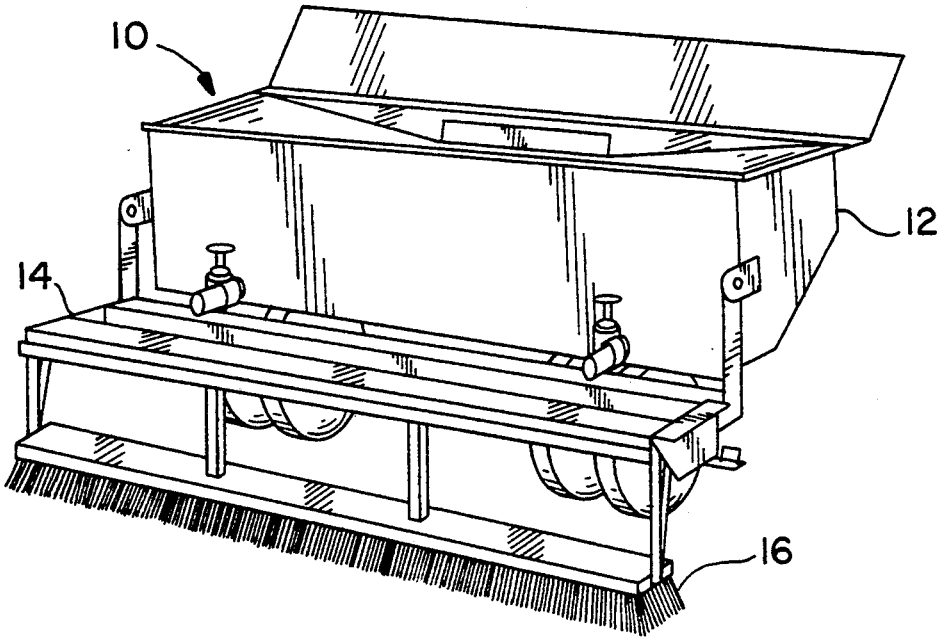
FIG. 1 is a perspective view of the sealant spreading apparatus.
Figure 2:
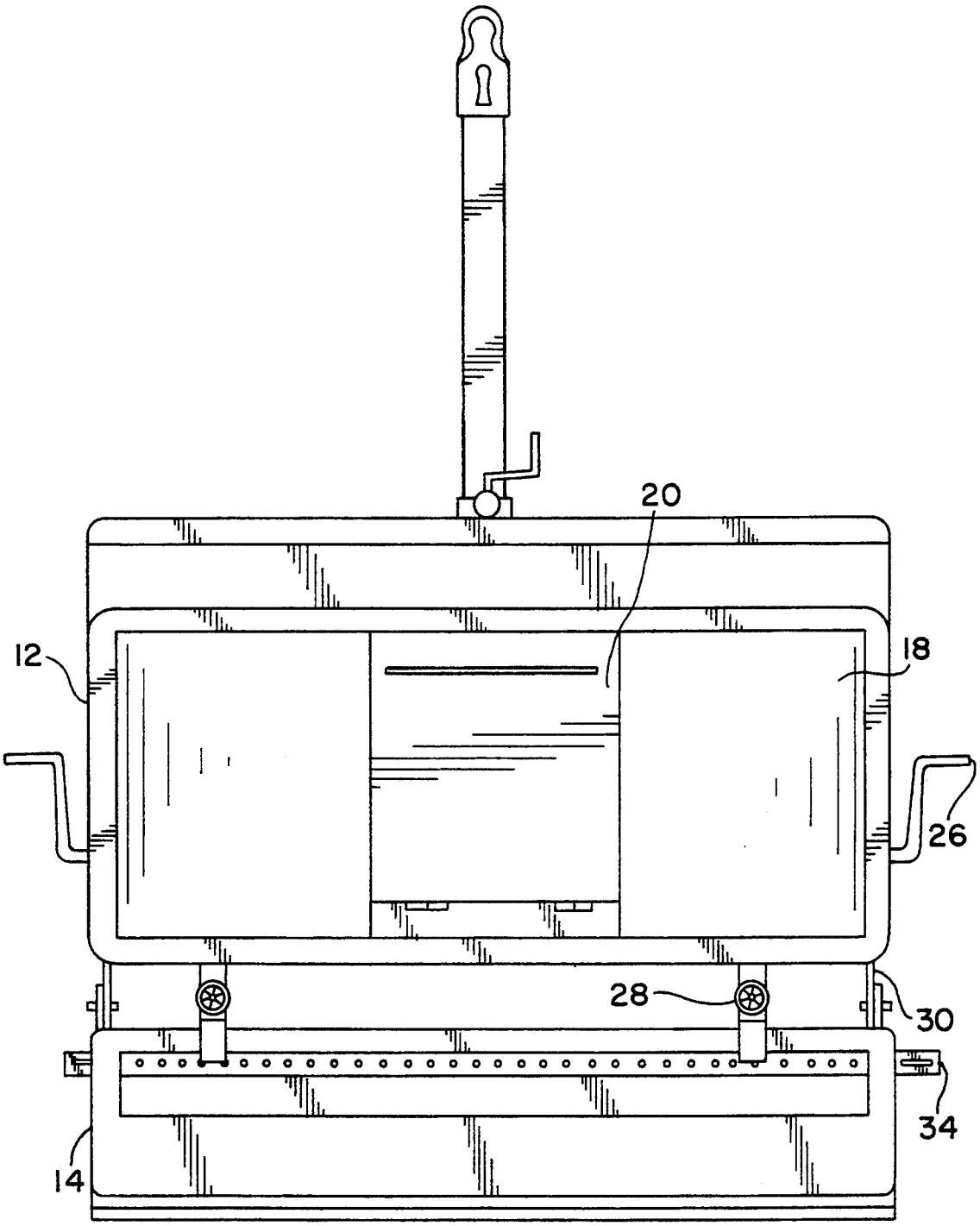
FIG. 2 is a top plan view of the sealant spreading apparatus.
Figure 3:
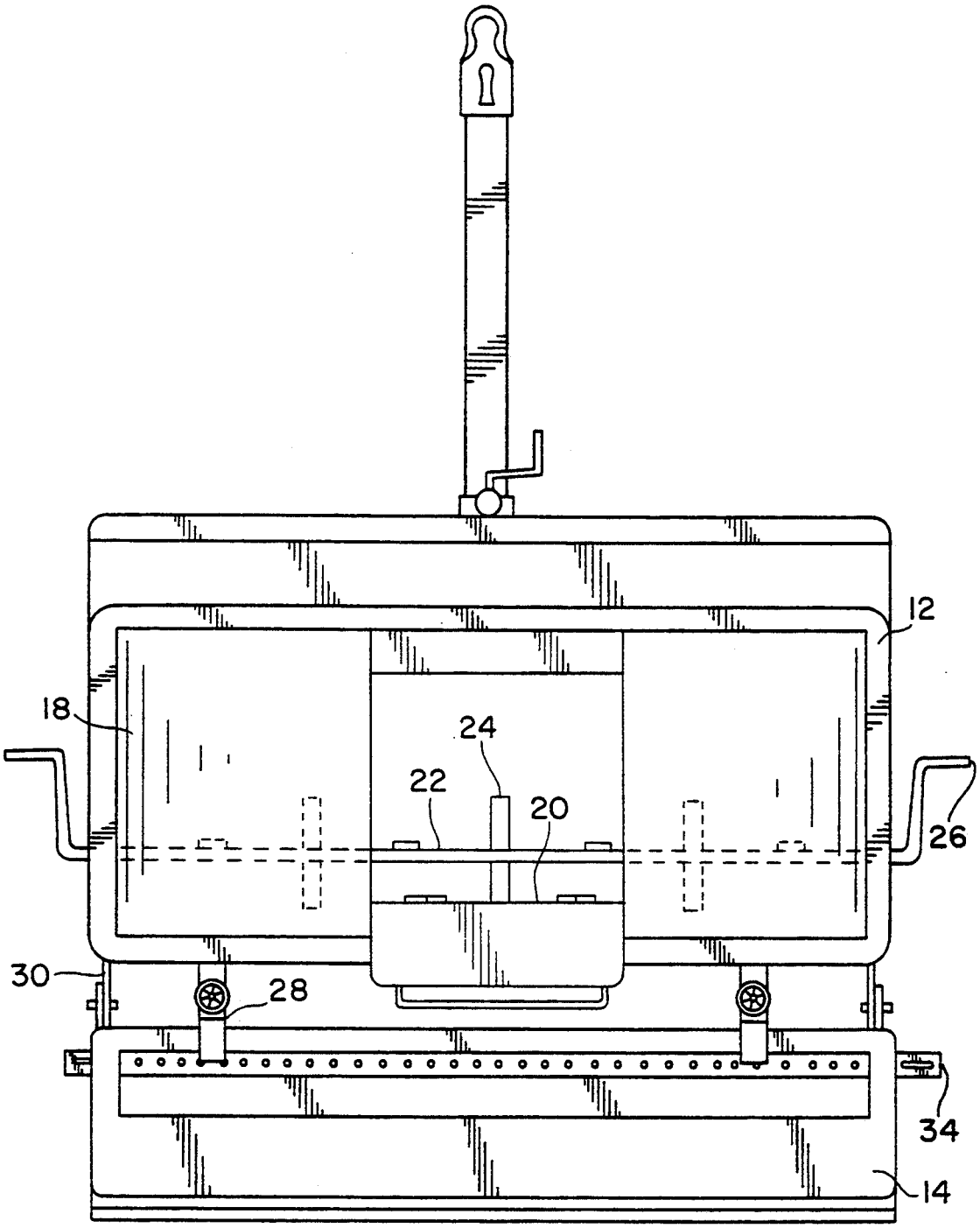
FIG. 3 is a top plan view of the apparatus partially showing the inside of the storage bin.

The inventive apparatus for spreading liquid sealant is generally indicated by the reference numeral 10 as shown in FIG. 1. It is comprised of a storage bin 12, drainage trough 14 and brush attachment 16. Storage bin 12 holds the sealant, or other liquid, where it can be mixed prior to dispersion onto the surface over which it is spread. The bin is constructed of ten gauge metal or other suitable material. A top cover 18 having a hatch 20 is provided to retain the sealant and keep it from splashing out. An agitator rod 22 with a plurality of radial spokes 24 is disposed within storage bin 12, as shown in FIG. 3, for mixing the sealant. Rod 22 extends through holes in the side walls of storage bin 12, and has handles 26 at its ends for an operator to crank. Spigots 28 allow for transfer of the mixed liquid from storage bin 12 to drainage trough 14.

Figure 4:
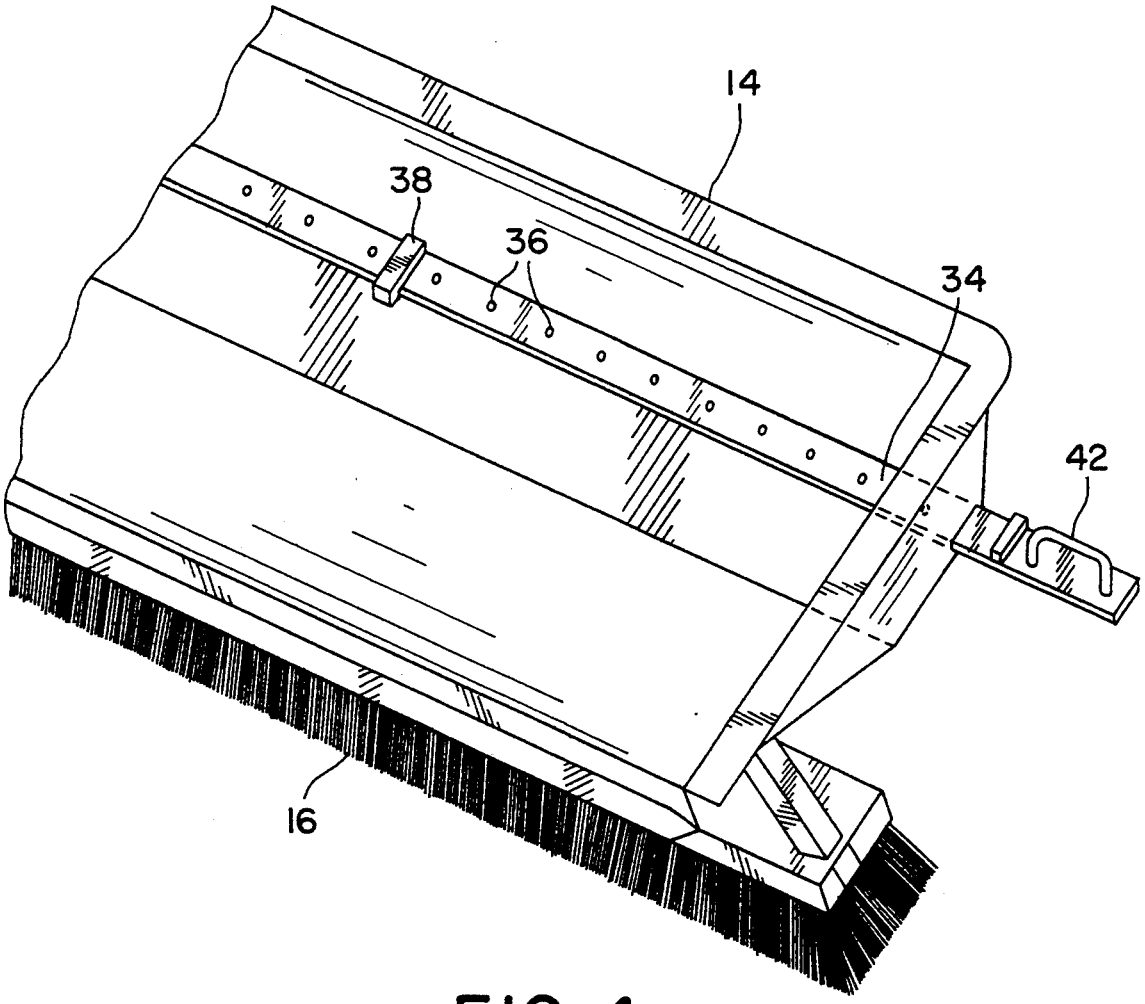
FIG. 4 is a perspective view partially showing the drainage trough and brush attachment.
Figure 5:
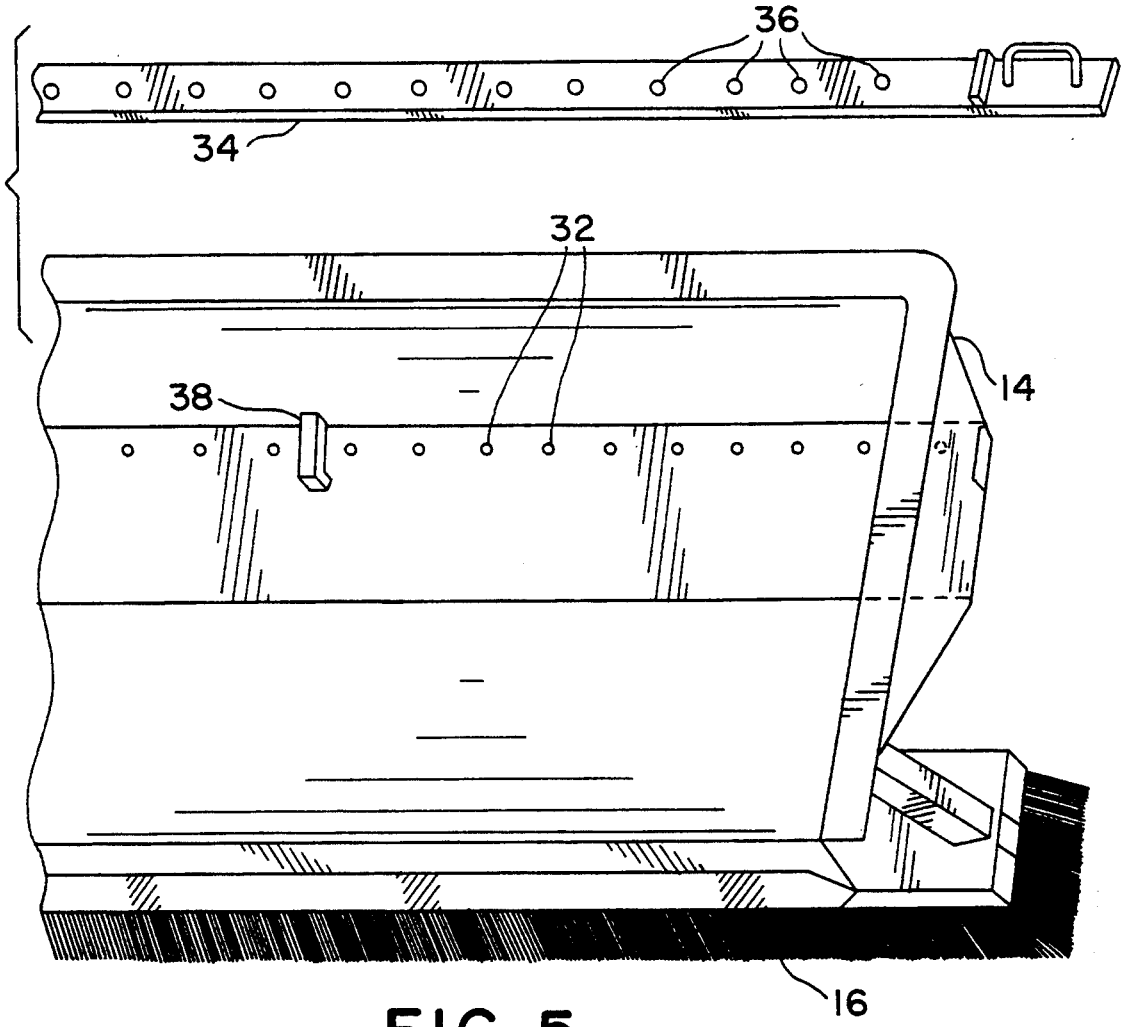
FIG. 5 is a perspective view partially showing the drainage trough with the slide bar flow regulator removed.
Figure 6:
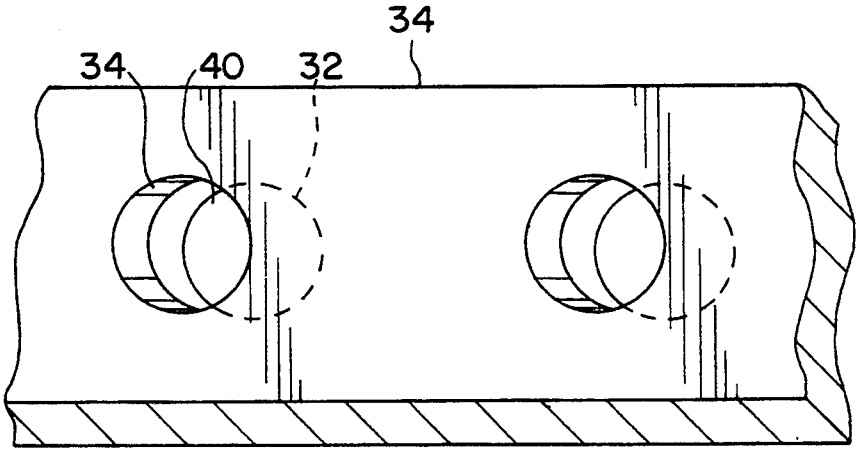
FIG. 6 is a schematic view of the flow regulation relationship between the slide bar and the bottom of the drainage trough.

Drainage trough 14 is situated behind and slightly below storage bin 12. It is hingedly connected by support arms 30 to storage bin 20 so that it may be swung between a position of operation during use, and a position of transport when not in use. Linch pins or other suitable locking means may be provided to secure the trough in the lowered operable position. A series of holes 32, as shown in FIG. 5, are provided along the bottom of trough 14 through which the sealant is dispersed onto the paved surface. Flow regulator 34 also has a series of holes 36 which are spaced in like arrangement to holes 32 in trough 14. Regulator 34 is an elongated bar member which is slidably received along the bottom of trough 14 as shown in FIG. 4 so that the holes 32 and 36 are in registry. This can be done either by providing a groove in the trough, or by using a retaining bracket guide 38 as shown, or by other means known to those skilled in the art. The effective diameter of trough holes 32 through which sealant is dispersed can be varied, by manipulation of handle 42 of regulator bar 34, to regulate the rate of flow. FIG. 6 schematically shows the holes 36 of regulator bar 34 moved out of alignment with holes 32 of trough 14 resulting in an aperture 40 of lesser dimension. By sliding regulator bar 34, the rate of flow through holes 32 can be lessened or completely shut off.

The width of the path of sealant dispersed from drainage trough 14 can also be regulated. A width regulator bar 60, comprised of a flat elongated member, is provided for placement over the outer holes 32 of drainage trough 14 on the underneath side as shown in FIG. 10. Its bottom surface is fitted with a rubber gasket 62 to provide a tight seal to prevent leakage of sealant from the covered holes. Brackets 64 are mounted on the underneath side of trough 14 to hold regulator bar 60 in linear alignment to the drainage holes 32. Thumbscrews or other tightening means 66 secure regulator bar 60 in place over the holes. Bar 60 can be slid along and over as many holes 32 as necessary to decrease the dispersion path width to accommodate the particular surface being sealed, such as a sidewalk. Flange 68 and peg and cotter pin 70 are employed as means to keep regulator bar from sliding out of brackets 64. There is sufficient tolerance between brackets 64 and bar 60 to allow bar 60 to be slid into and out of position over drainage holes 32 as shown in FIGS. 10 and 11.

Figure 7:
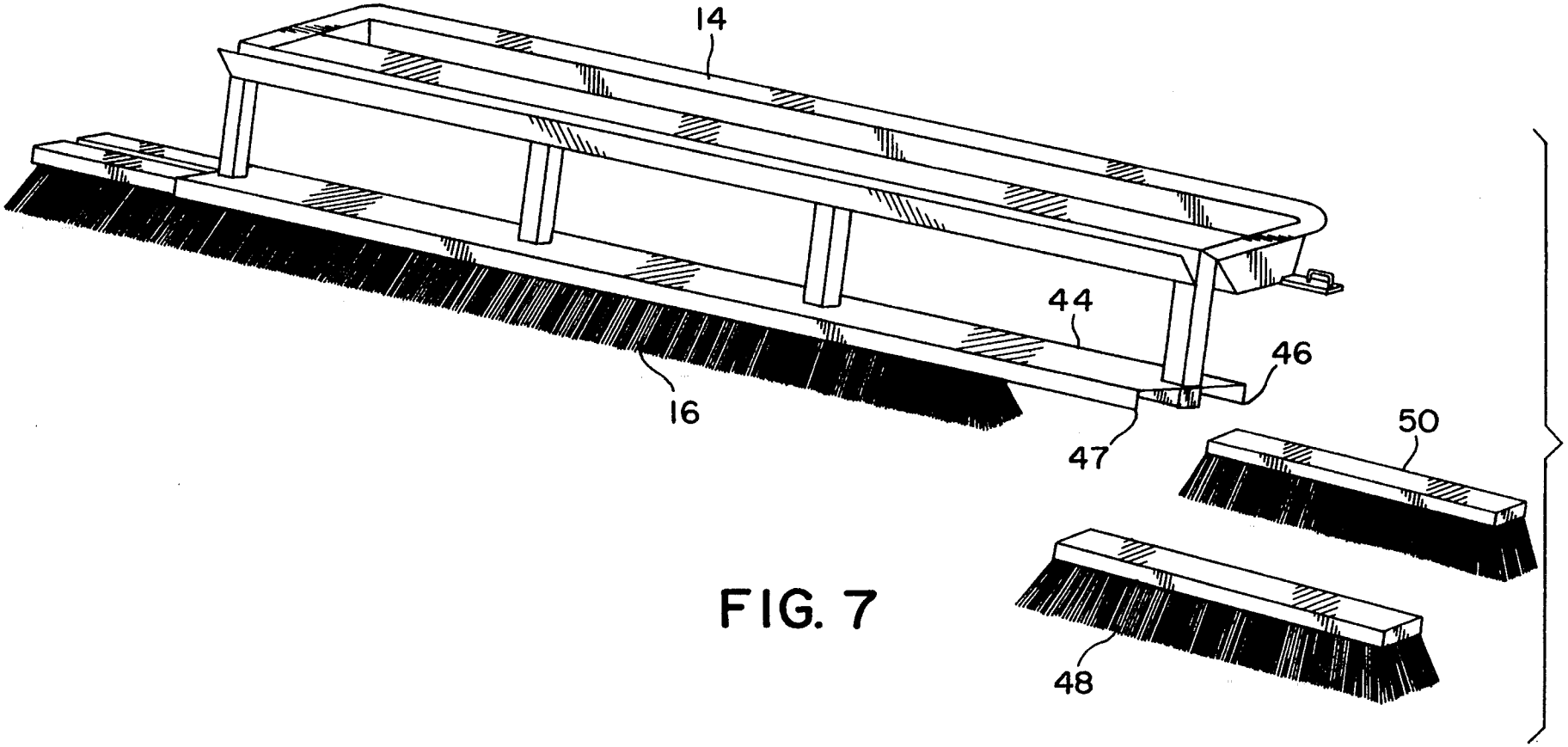
FIG. 7 is a perspective view of the drainage trough and brush attachments.
Figure 8:
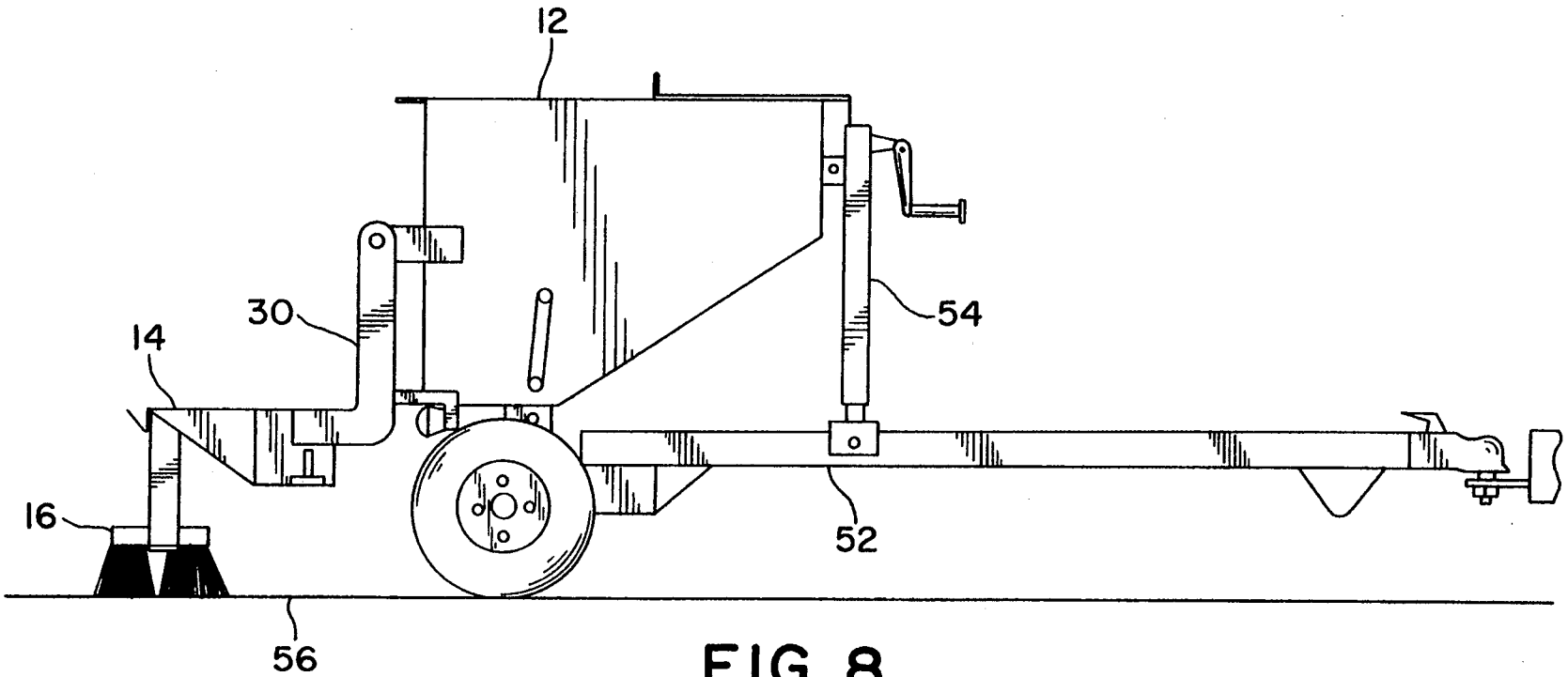
FIG. 8 is a view in side elevation from the side of the sealant spreading apparatus with the drainage trough assembly in operable position.

Brush attachment 16 is comprised of a housing 44 which is attached to drainage trough 14 anteriorly of drainage holes 32. Housing 44 forms a channel track 46 running along its entire length which approximates the length of drainage trough 14. Track 46, as shown in FIG. 7, has retaining flanges 47 which accommodate the rectangular rigid base 50 of brush members 48, which may be of the standard push-broom type having stiff bristles. Various means can be used for securing the brushes in the track, such as thumbscrews, ball and socket, friction fit, and the like. Other spreading brushes may be used as necessary, such as those having sponge material, soft bristles or other suitable medium. Track 46, which can also comprise dual channels as shown, can accommodate either a long brush spanning the length of the track, or can receive a plurality of short brushes. Because the brush member is slidable within track 46, the effective width of brush attachment 16 can be increased by partially withdrawing a brush member 48 from track 46 as shown in FIG. 7. With a dual channel, one brush member in a first channel may be partially withdrawn from one end of track 46, while another brush member in the second channel may be partially withdrawn from the opposite end.

The spreading apparatus 10 is mountable on a trailer dolly 52 for mobility in applying the sealant and for being transported to and from the job site. It can be welded on the trailer structure or removably attached by bolts or the like. Optimally, however, storage bin 20 should be attached in a manner such that it is pivotable in the vertical plane. A cylinder jack 54 provides support for storage bin 12, and is used to tilt bin 12 back and forth as necessary to level brush attachment 16 in relation to surface 56 on which sealant is spread. Jack 54 can also increase the degree of pressure to which brush members 48 contact surface 56 for a different spreading effect. Because brush attachment 16 is connected to drainage trough 14, which is hingedly connected to storage bin 12, movement of levelling jack 54 will have a relative effect on brush attachment 16. Drainage trough 14 can be locked into place during operation to prevent brush attachment 16 from swinging out of place when levelling jack 54 is raised.

USE

The apparatus of the instant invention is very simply employed for spreading liquids such as sealants and the like. It enables the user to quickly and efficiently seal a paved surface which would otherwise have to be done manually. Sealant is loaded into storage bin 12 where it is mixed prior to spreading. This can be done either by hand or by turning agitator rod 22. Once properly mixed, it is transferred to drainage trough 14 via spigots 28. The rate of flow into the trough can be adjusted by manipulation of the valve handles on the spigots.

As the apparatus is towed along, the rate of flow of sealant through drainage holes 32 onto the surface is controlled by sliding regulator bar 34 such that holes 36 move out of registry with holes 32, as shown in FIG. 6. The condition of the surface will dictate the amount of sealant needed. Drained sealant is immediately spread over the surface by brush attachment 16, which can be comprised either of stiff bristles or spongy squeegee material. The pressure applied by brush attachment 16 can be increased by raising levelling jack 54 to tilt storage bin 12 back. To obtain a wider spreading path, brush members 48 can be partially withdrawn from opposite ends of dual track 46. For a single track, an additional shorter brush member may be added in one end. To obtain a narrower spreading path, regulator bar 60 is moved into position over the outer holes 32 of either or both ends of drainage trough 14 to block dispersion of sealant from those holes. Only the inner holes 32 will disperse sealant thus narrowing the effective width of the dispersion path. This would be applicable for use on sidewalks, or narrow paths such as found on golf courses.

Figure 9:
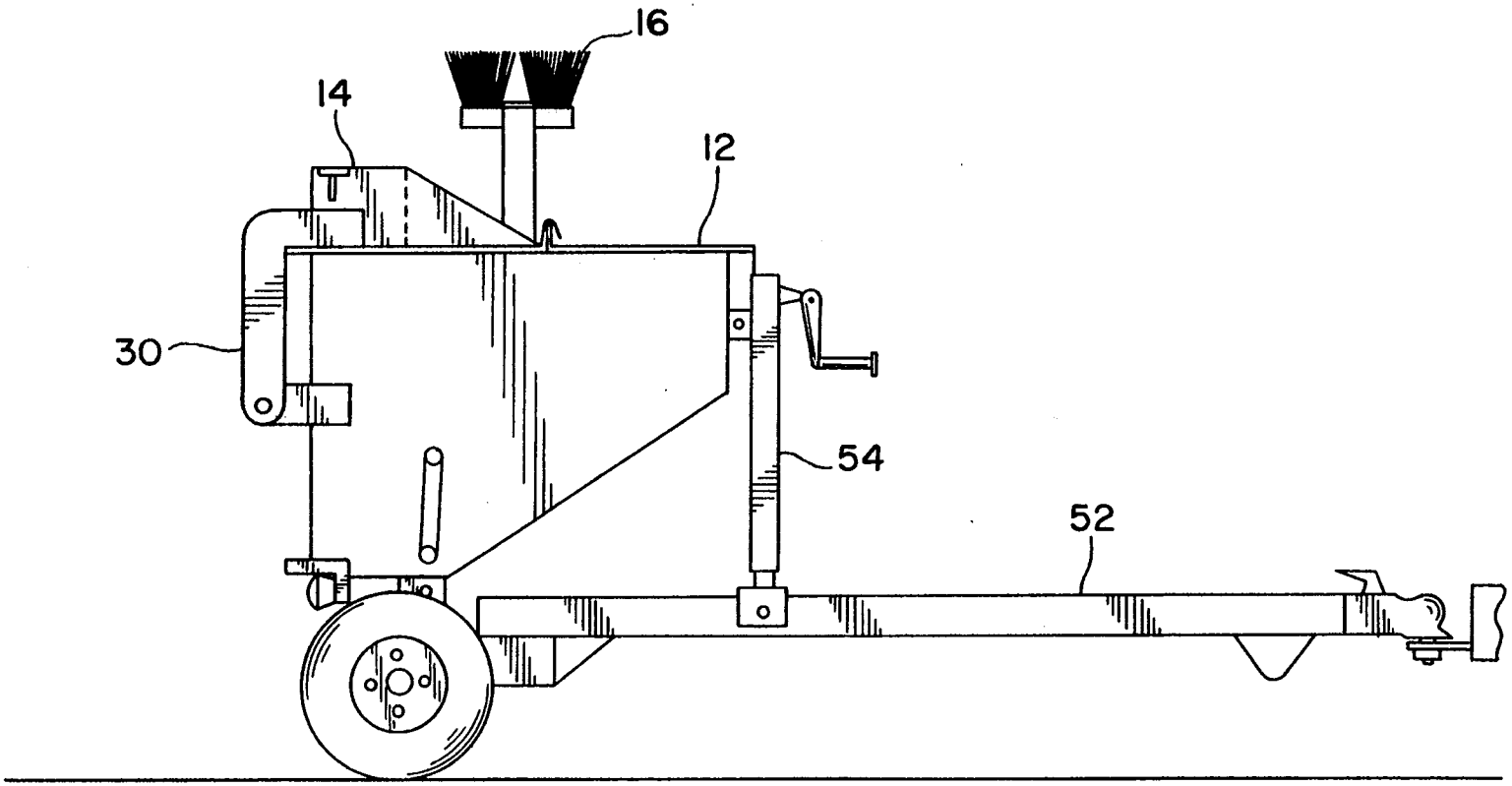
FIG. 9 is a view in side elevation from the side of the sealant spreading apparatus with the drainage trough assembly in transport position.

Dolly 52 enables the apparatus to be easily drawn over the surface to be sealed. It can be towed by virtually any type of vehicle having a compatible hitch, such as a truck, tractor, or all terrain vehicle. The apparatus is easily and safely transportable between jobs in that the drainage trough 14 and brush attachment 16 can be retracted to a stowed position as shown in FIG. 9. By virtue of its hinged connection, trough 14 is swung up and forward to rest on top of storage bin 12 and secured into place. The apparatus can be equipped with a lighting system and other required equipment for safe transportation of trailers.

Various changes and modifications may be made within this invention as will be apparent to those skilled in the art. For instance, the structure of storage bin 12 may be modified so that sealant can be dispersed directly from the bin onto the surface to eliminate the need for a drainage trough. The brush attachment would then be directly connected to the storage bin in hinged relationship so that it could pivot between positions of operation and transport. The storage bin could be adapted with flow control means such as are present in the drainage trough. Such changes and modifications are within the scope and teaching of this invention as defined in the claims appended hereto.

What is claimed is:

1. An apparatus for spreading a liquid over a surface, said apparatus comprising a storage bin for containing said liquid to be spread, a drainage trough, and spreading means, said drainage trough and spreading means being positioned posteriorly of said storage bin and spanning a width of said apparatus, said storage bin having means for distributing said liquid into said drainage trough, said trough having means for dispersing said liquid onto said surface in a swath anteriorly of said spreading means, said apparatus having means for being towed by a vehicle, whereby said liquid is spread over said surface.

2. The apparatus of claim 1 in which said trough has means for varying a rate of flow of said liquid to be dispersed.

3. The apparatus of claim 2 in which said trough has a first plurality of openings disposed along a bottom of said trough through which said liquid to be dispersed flows, means being provided for covering said openings, whereby an effective diameter of said openings is varied.

4. The apparatus of claim 3 in which an elongated member having a like arrangement of a second plurality of openings is disposed along said bottom of said trough such that said second plurality of openings align with said first plurality of openings, said elongated member having means for being moveable in relation to said first plurality of openings, whereby said second plurality of openings move out of alignment with and cover said first plurality of openings to vary their said effective diameter.

5. The apparatus of claim 2 in which means are provided for selectively sealing a number of said first plurality of openings from at least at one end of said trough, whereby an effective width of said dispersion swath from said trough is adjustable.

6. The apparatus of claim 1 in which said spreading means comprises a brush housing member and at least one brush member, said housing member having a channel to receive in sliding relationship a base member of said brush member, said brush member being removable.

7. The apparatus of claim 6 in which said channel has dual tracks, said channel receiving at least two brush members in parallel relationship, a first of said brush members being partially withdrawn from a first track at a first end of said channel such that said first brush member extends out from said first end of said channel, a second of said brush members being partially withdrawn from a second track at a second end of said channel such that said second brush member extends out from said second end of said channel, whereby an effective width of said spreading means is increased.

8. The apparatus of claim 1 in which said storage bin has means for mixing said liquid.

9. The apparatus of claim 8 in which said means for mixing comprises a hand operable agitator, said agitator comprising an elongated rod member extending through said bin, said rod member having a plurality of radial time members, handle means being provided at an end of said rod member exteriorly of said bin.

10. The apparatus of claim 1 in which levelling means are provided to adjust the orientation of said apparatus over a range within a vertical plane with respect to said surface for bringing said spreading means into contact with said surface.

11. The apparatus of claim 1 in which said trough has means for varying a rate of flow and a width of said swath of said liquid to be dispersed, and said spreading means comprises a brush housing member and at least one brush member, said housing member having a channel to receive in sliding relationship a base member of said brush member, said brush member being removable.

12. The apparatus of claim 11 in which said trough has a first plurality of openings disposed along a bottom of said trough through which said liquid to be dispersed flows, an elongated member having a like arrangement of a second plurality of openings being disposed along said bottom of said trough such that said second plurality of openings align with said first plurality of openings, said elongated member having means for being moveable in relation to said first plurality of openings, whereby said second plurality of openings move out of alignment with and cover said first plurality of openings, whereby an effective diameter of said openings is adjustable to vary said rate of flow, means further being provided for selectively sealing a number of said first plurality of openings from at least at one end of said trough, whereby an effective width of said dispersion swath from said trough is adjustable.

13. The apparatus of claim 11 in which said channel has dual tracks, said channel receiving at least two brush members in parallel relationship, a first of said brush members being partially withdrawn from a first track at a first end of said channel such that said first brush member extends out from said first end of said channel, a second of said brush members being partially withdrawn from a second track at a second end of said channel such that said second brush member extends out from said second end of said channel, whereby an effective width of said spreading means is increased.

14. The apparatus of claim 11 in which said storage bin has means for mixing said liquid, said means for mixing comprising a hand operable agitator, said agitator comprising an elongated rod member extending through said bin, said rod member having a plurality of radial tine members, and handle means for turning said agitator being provided at an end of said rod member exteriorly of said bin.

15. The apparatus of claim 11 in which levelling means are provided to adjust the orientation of said apparatus over a range within a vertical plane with respect to said surface for bringing said spreading means into contact with said surface.

16. The apparatus of claim 1 in which said drainage through is hingedly connected to said storage bin, whereby said drainage trough is pivotable between positions of engagement during operation, and stowage during transportation.

17. The apparatus of claim 15 in which said drainage trough is hingedly connected to said storage bin, whereby said drainage trough is pivotable between positions of engagement during operation, and stowage during transportation.

* * * * *

UNITED STATES PATENT AND TRADEMARK OFFICE

CERTIFICATE OF CORRECTION

PATENT NO. : 5,362,178
DATED : November 8, 1994
INVENTOR(S) : Schantz. John S.

It is certified that error appears in the above-indentified patent and that said Letters Patent is hereby corrected as shown below:

In Column 5, claim 9, line 58, "time" should be --tine --.

In Column 6, claim 16, line 53, 'through" should be --trough --.

Signed and Sealed this

Thirty-first Day of January, 1995

*Attest:*

Bruce Lehman

BRUCE LEHMAN

*Attesting Officer*

*Commissioner of Patents and Trademarks*